US006398579B1

(12) United States Patent
Banas et al.

(10) Patent No.: US 6,398,579 B1
(45) Date of Patent: Jun. 4, 2002

(54) ELECTRICAL CONNECTOR ASSEMBLY

(75) Inventors: Henry J. Banas, Gales Ferry, CT (US); Paul E. Moody, Barrington, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/845,223

(22) Filed: May 1, 2001

(51) Int. Cl.[7] ..... H01R 13/62; H01R 13/64; H01R 13/627

(52) U.S. Cl. ..... 439/372; 439/350

(58) Field of Search ..... 439/372, 350, 439/357, 358

(56) References Cited

U.S. PATENT DOCUMENTS 4,431,244 A * 2/1984 Anhalt et al. ..... 439/358

* cited by examiner

*Primary Examiner*—Brian Sircus
*Assistant Examiner*—Chandrika Prasad
(74) *Attorney, Agent, or Firm*—Michael J. McGowan; James M. Kasischke; Prithvi C. Lall

(57) ABSTRACT

An electrical connector assembly including a female connector assembly and a male connector assembly configured for quick push-pull connect and for squeeze-to-release disconnect. The female and male connector assemblies are each molded of a plastics material.

8 Claims, 2 Drawing Sheets

ELECTRICAL CONNECTOR ASSEMBLY

STATEMENT OF GOVERNMENT INTEREST

The invention described herein may be manufactured and used by and for the Government of the United States of America for Governmental purposes without the payment of any royalties thereon or therefor.

CROSS-REFERENCE TO RELATED PATENT APPLICATIONS

Not applicable.

BACKGROUND OF THE INVENTION (1) Field of the Invention

The invention relates to electrical connector assemblies and is directed more particularly to a quick connect and disconnect assembly.

(2) Description of the Prior Art

It is common to provide electrical connectors which require a relatively long time to connect and disconnect. Some connectors are threaded. The threads typically are of fine pitch and become jammed or cross-threaded in harsh or dirty environments. Mis-threaded connectors become useless and must be replaced with newly wired connectors. Many connectors separate when subjected to sustained periods of vibration. Many connectors are subject to corrosion and must frequently be replaced in salt water environments.

Accordingly, there is a need for an electrical connector assembly of a quick connect-disconnect type, which is not threaded, which will not separate under sustained vibration, and will not corrode, even in salt water environments.

SUMMARY OF THE INVENTION

An object of the invention is, therefore, to provide an electrical connector assembly wherein one connector is simply snapped into another connector without the use of threads and is easily released from the other connector.

A further object of the invention is to provide such a connector assembly which is unaffected by sustained vibrations.

A still further object of the invention is to provide such a connector assembly of a molded, non-corrodable, lightweight plastics material, to eliminate machining and the use of screws, seals and end caps, as is common with metal connectors.

A still further object of the invention is to provide such a connector assembly requiring no tools for connection or disconnection.

With the above and other objects inview, as will hereinafter appear, a feature of the invention is the provision of an electrical connector assembly including a female connector assembly comprising a base portion and a cylindrically-configured housing portion extending from the base portion and comprising a wall defining a chamber. An electrically conductive pin is disposed centrally of the base portion and the housing portion and extends axially therethrough. An annular wall extends from the chamber wall inwardly and normal to the chamber wall to define a central opening, and opposed claws extend from the chamber wall and are provided with inwardly extending opposed fingers, the claws being pivotally movable about their respective junctures with the annular wall. The electrical connector assembly further includes a male connector assembly comprising a base portion and a body portion comprising an enlarged continuation of the male connector assembly base portion. An annular retention ring is fixed on the male connector assembly body portion. A barrel portion extends from the body portion. An electrically conductive wire extends axially through the base portion, the body portion, and the barrel portion. A sleeve portion, open at one end, is retained in the barrel portion for receiving the pin. Upon urging of the male connector assembly into the female connector assembly, a leading edge of the retention ring engages the claw fingers forcing the claws in directions away from each other permitting the retention ring to slide past the claw fingers, permitting said male connector assembly barrel portion to pass through the female connector assembly annular wall central opening, and permitting entry of the pin into the sleeve portion open end. Upon an operator's squeezing of the housing portion of the female connector assembly, the claws pivot from the junctures of the claws and the female connector assembly annular wall, moving in directions away from each other, permitting the claw fingers to disengage from the retention ring, permitting the male connector assembly to be withdrawn from the female connector assembly, disconnecting the pin from the sleeve.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
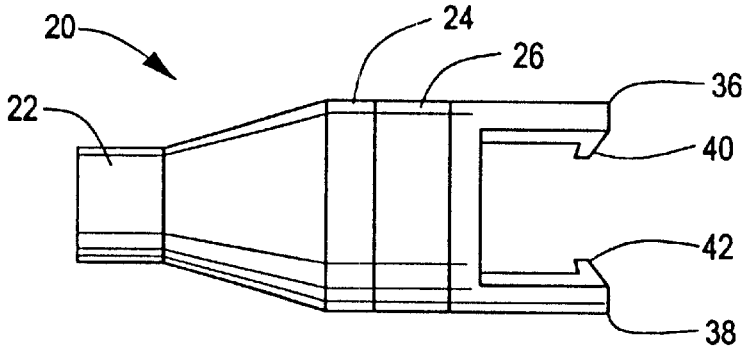
FIG. 1 is a side elevational view of a female connector assembly portion of an electrical connector assembly.
Figure 2:
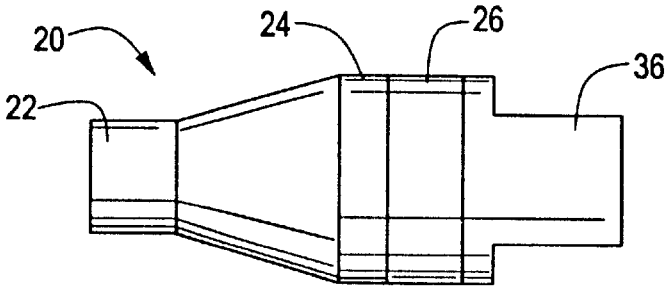
FIG. 2 is a top plan view of the female connector assembly portion of FIG. 1.
Figure 3:
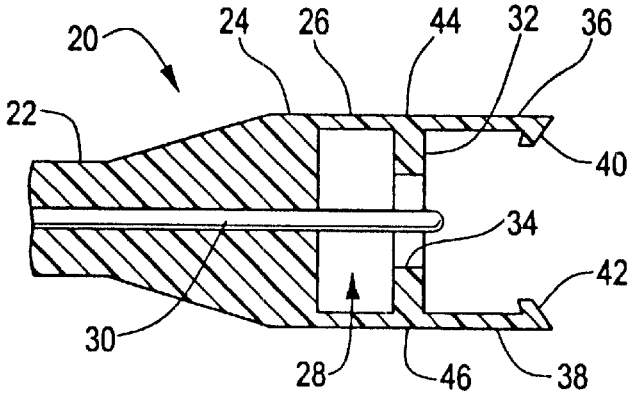
FIG. 3 is a centerline sectional view of the female connector assembly portion of FIG. 1.

Referring to FIGS. 1–3, it will be seen that an illustrative female connector assembly 20 includes a base portion 22 and a cylindrically-configured housing portion 24 extending from the base portion 22 and comprising, in part, a wall 26 defining a chamber 28 (FIG. 3).

An electrically conductive pin 30 is disposed centrally within the base portion 22 and the housing portion 24, and extends axially therethrough. An annular wall 32 extends from the chamber wall 26 inwardly and substantially normal to the chamber wall 26 to define a central opening 34. The pin 30 extends through the opening 34 and axially thereof.

Figure 6:
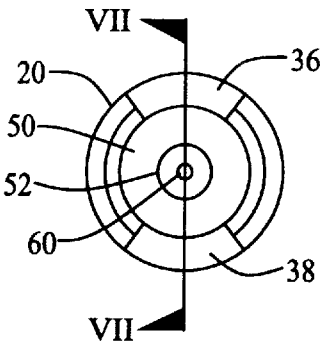
FIG. 6 is an end view of the electrical connector assembly.
Figure 7:
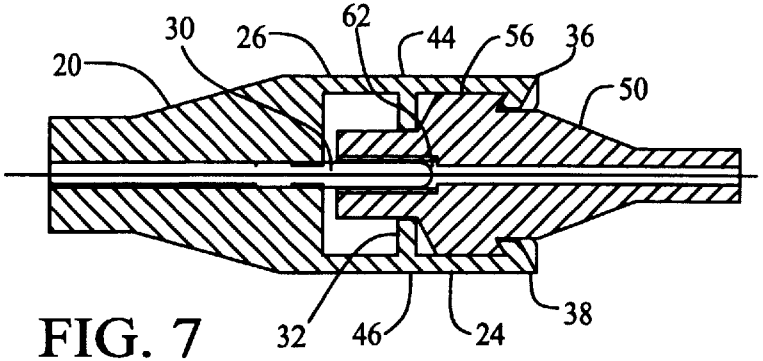
FIG. 7 is a sectional view along line VII—VII of FIG. 6.

Opposed claw members 36, 38 extend from the chamber wall 26 and are each provided with inwardly extending opposed fingers 40, 42. The claw members 36, 38 are arc-shaped (FIG. 6) and pivotally movable about their respective junctures 44, 46 with the annular wall 32.

Figure 4:
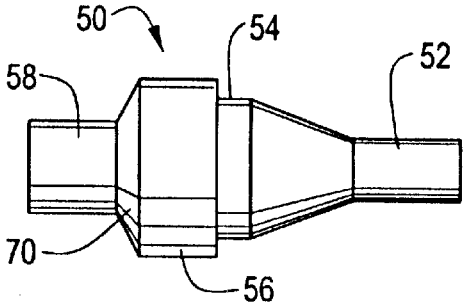
FIG. 4 is a side elevational view of a male connector assembly portion of the electrical connector assembly.
Figure 5:
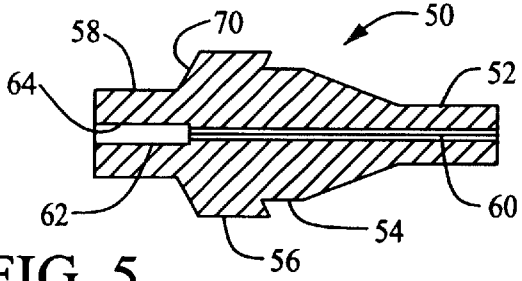
FIG. 5 is a centerline sectional view of the male connector assembly portion of FIG. 4.

Referring to FIGS. 4 and 5, it will be seen that an illustrative male connector assembly 50 includes a base portion 52 and a body portion 54 comprising an enlarged continuation of the male connector assembly base portion 52. An annular retention ring 56 is fixed on the male connector assembly body portion 54. A barrel portion 58 extends from the body portion 54.

An electrically conductive wire 60 extends axially through the base portion 52, body portion 54, and barrel portion 58. The wire 60 is provided with a sleeve portion 62 open at one end 64 (FIG. 5) to receive and make contact with the pin 30.

In operation, upon urging of the male connector assembly 50 into female connector assembly 20, a leading edge 70 of retention ring 56 engages claw fingers 40, 42 to force claw members 36, 38 in directions away from each other to permit retention ring 56 to slide past the claw fingers. The male connector assembly barrel portion 58 is permitted to pass through the female connector assembly annular wall central opening 34, to permit entry of pin 30 into sleeve portion 62 to complete electrical connection.

By manually pulling the connector assemblies 20, 50 away from each other, an operator can test whether the connector assemblies are attached to each other. If securely attached, the connector assemblies remain connected in spite of axial forces in directions tending to pull them apart.

Figure 8:
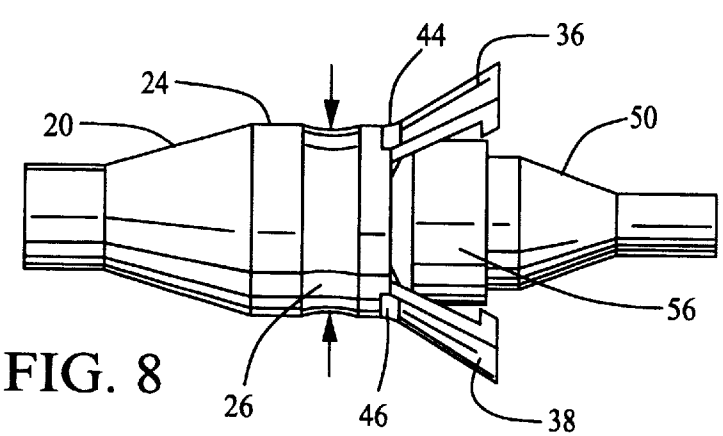
FIG. 8 is a side elevational view of the electrical connector assembly preparatory to separating the male and female connector assembly portions.
Figure 9:
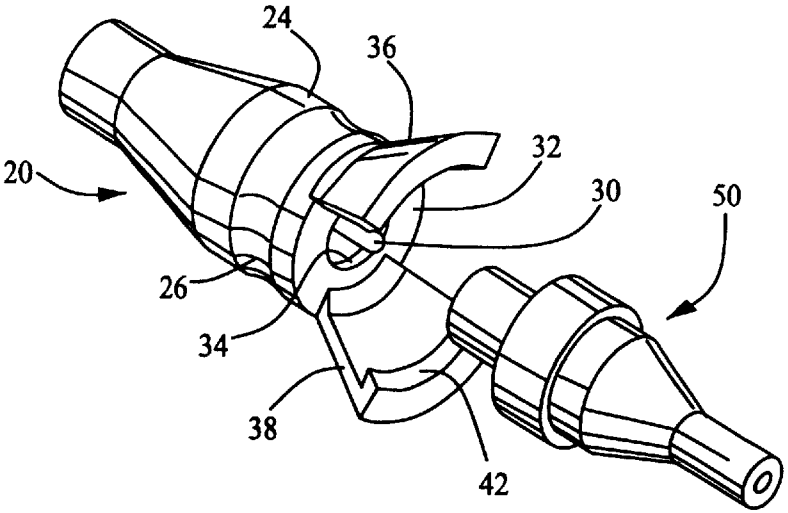
FIG. 9 is a perspective view of the assembly of FIG. 8 with the male and female connector assembly portions separated.

To disconnect the connector assemblies 20, 50 an operator applies squeezing pressure on the wall 26 of the housing portion 24 of female connector assembly 20. The squeezing pressure applied to wall 26 in areas proximate the bases of the claws 36, 38, causes the wall 26 to compress inwardly (FIG. 8) and claws 36 38 to pivot outwardly from annular wall 32 at junctures 44, 46. The fingers 40, 42 of claws 36, 38 are thus moved outwardly from retention ring 56, permitting the connectors 20, 50 to be axially pulled apart (FIG. 9).

There is thus provided a connector assembly which may be easily and quickly connected and disconnected, without threaded connections and without tools, and which is not loosened by vibrations. Preferably, the connectors 20, 50 are each integral, unitary molded plastic members (other than pin 30 and wire 60) and are not subject to corrosion.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. An electrical connector assembly comprising:

a female connector assembly comprising:

a female base portion;

a cylindrically-configured housing portion extending from said base portion and comprising a first annular wall defining a chamber;

an electrically conductive pin disposed centrally of said base portion and said housing portion and extending axially therethrough;

a second annular wall extending from the housing portion first annular wall inwardly and normal to the housing portion first annular wall to define a central opening; and arc-shaped opposed claws extending longitudinally from the housing portion first annular wall and the second annular wall and provided with inwardly extending opposed fingers, said claws being pivotally movable about their respective junctures with said housing portion annular walls; and a male connector assembly comprising:

a male base portion;

an annular retention ring fixed on said male base portion and extending circumferentially completely therearound;

a cylindrically-configured barrel portion extending from said male base portion; and an electrically conductive wire extending centrally and axially through said male base portion, and said barrel portion, and having in said barrel portion a sleeve portion open at one end to receive said pin;

wherein upon urging said male connector assembly into said female connector assembly, a leading edge of said annular retention ring engages said arc-shaped claw fingers to force said claws in directions away from each other to permit said retention ring to slide past said claw fingers, to permit said male connector assembly barrel portion to pass through said female connector assembly second annular wall central opening, to permit entry of said pin into said sleeve portion open end; and wherein upon an operator's squeezing of said housing portion of said female connector assembly, said claws pivot from said junctures of said claws and said female connector assembly annular walls, to move in directions away from each other, to permit said claw fingers to disengage from said retention ring, to permit said male connector assembly to be withdrawn from said female connector assembly, to disconnect said pin from said sleeve.

2. The electrical connector assembly in accordance with claim 1 wherein:

said female connector assembly base portion, housing portion, annular walls, and claws comprise a single, unitary molded first piece; and said male connector assembly base portion, retention ring, and barrel portion comprise a second single, unitary molded piece.

3. The electrical connector assembly in accordance with claim 2 wherein said first and second unitary pieces are molded of a plastic material.

4. The electrical connector in accordance with claim 1 wherein said housing portion first annular wall defining the chamber is compressible into the chamber by the operator's squeezing to cause said claws to pivot.

5. An electrical connector assembly for joining a first cable end and a second cable end comprising:

a female base portion for joining with said first cable end;

a housing portion extending from said female base portion, said housing portion having a cylindrically-configured wall defining a chamber;

at least one electrically conductive pin disposed within said female base portion and extending therethrough into said defined chamber, said at least one pin provided for communicating with said first cable end;

an inwardly extending wall extending normally inwardly from said housing portion cylindrically-configured wall and defining a central opening therein;

arc-shaped opposed claws extending longitudinally from said housing portion cylindrically-configured wall and said inwardly extending wall and provided with inwardly extending opposed fingers, said arc-shaped claws being pivotally movable about their respective junctures with said housing portion walls;

a male base portion for joining with said second cable end;

a retention ridge fixed on said male base portion and extending circumferentially completely therearound;

a barrel portion extending from said male base portion; and at least one electrically conducting sleeve positioned in said barrel portion and open at one end for receiving said one pin, said at least one electrically conducting sleeve being provided for communicating with said second cable end;

wherein upon urging said barrel portion into said defined central opening, a leading edge of said retention ridge engages said claw fingers to force said claws outward to permit said retention ridge to slide past said claw fingers and to permit reception of one electrically conducting pin within one electrically conducting sleeve open end; and wherein upon an operator's squeezing said housing portion, said claws pivot from said junctures of said claws and said cylindrically-configured housing portion wall and said inwardly extending wall to move outward and to permit said claw fingers to disengage from said retention ridge, to permit said sleeve housing to be withdrawn from said defined central opening and said one electrically conducting pin to be removed from said electrically conducting one sleeve.

6. The electrical connector assembly in accordance with claim 5 wherein:

said female connector assembly base portion, housing portion, inwardly extending wall, and claws comprise a first single, unitary molded piece; and said male connector assembly base portion and retention ridge comprise a second single, unitary molded piece.

7. The electrical connector assembly in accordance with claim 6 wherein said first and second unitary pieces are molded of a plastic material.

8. The electrical connector in accordance with claim 5 wherein said housing portion wall defining the chamber is compressible into the chamber by the operator's squeezing to cause said claws to pivot.

* * * * *